United States Patent [19]

Arthur

[11] Patent Number: 4,928,713

[45] Date of Patent: May 29, 1990

[54] CIGARETTE MAKING MACHINES

[75] Inventor: Hugh M. Arthur, Bucks, England

[73] Assignee: Molins PLC, Milton Keynes, England

[21] Appl. No.: 94,727

[22] PCT Filed: Dec. 19, 1986

[86] PCT No.: PCT/GB86/00785

§ 371 Date: Aug. 20, 1987

§ 102(e) Date: Aug. 20, 1987

[87] PCT Pub. No.: WO87/03787

PCT Pub. Date: Jul. 2, 1987

[30] Foreign Application Priority Data

Dec. 20, 1985 [GB] United Kingdom ..... 8531506

[51] Int. Cl.[5] ..... A24C 5/28; A24C 5/31

[52] U.S. Cl. ..... 131/84.1; 131/84.4; 131/280; 83/72; 83/76; 83/298; 493/45

[58] Field of Search ..... 131/280, 84.1, 84.4, 131/906, 907, 908, 910; 83/72, 76, 298; 493/45

[56] References Cited

U.S. PATENT DOCUMENTS 4,372,327 2/1983 Dyett et al. ..... 131/95

4,463,766 8/1984 Arthur et al. ..... 131/280

*Primary Examiner*—V. Millin

*Attorney, Agent, or Firm*—Antonelli, Terry, Stout & Kraus

[57] ABSTRACT

A rod cut-off in a cigarette making machine includes a cutting device 32 having a first drive 34, a ledger 10 for supporting the rod during cutting and having a second drive 22, separate from the first drive, a device for synchronizing (prefereably electronically) the first and second drives during normal operation, and a device 40 for mechanically displacing the ledger or cutting device (preferably the former) from the normal position in which it co-operates with the other member to perform rod cutting, the displacement being arranged to occur while the machine is being accelerated from start; that is, during the time while the two drives are being brought into synchronization.

8 Claims, 1 Drawing Sheet

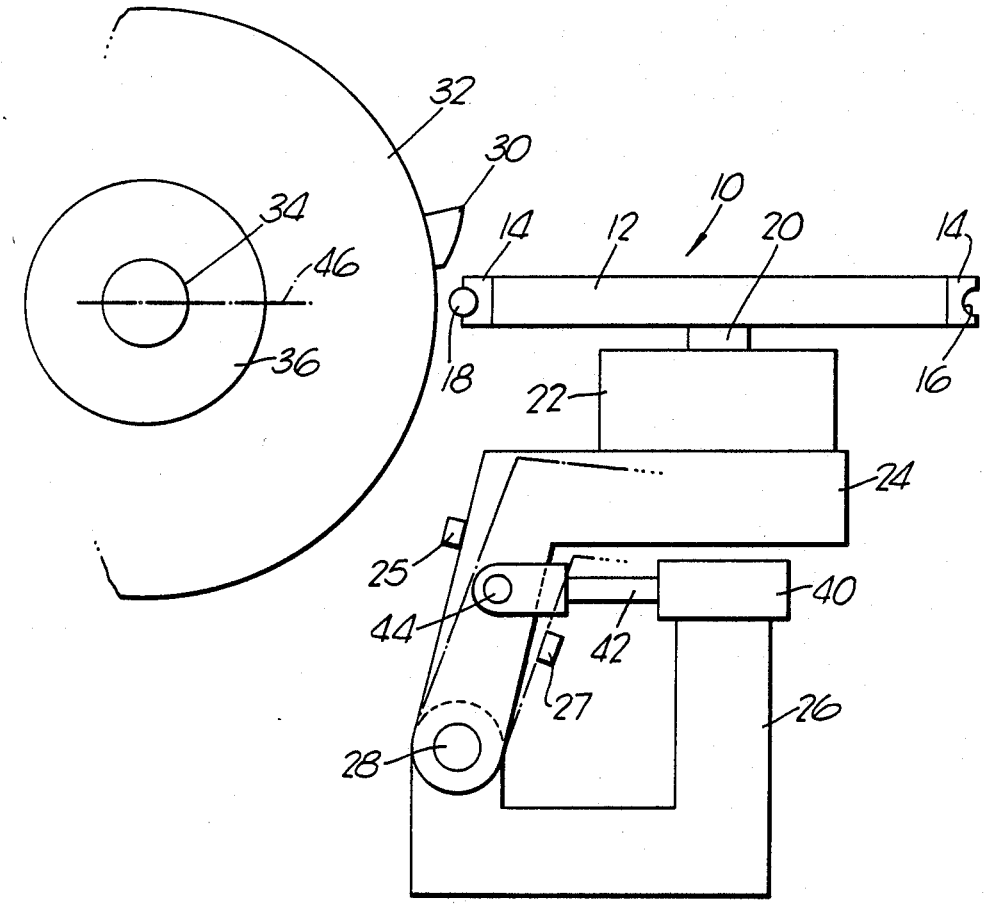
32
30
10
34
14
12
20
14
46
36
18
16
22
24
25
40
44
42
27
26
28

CIGARETTE MAKING MACHINES

This invention is concerned with the manufacture of cigarettes and other rods of the cigarette industry, including filter rods. it will, however, for convenience be described in terms of cigarettes.

Out U.S. Pat. No. No. 4,463,766 describes an invention involving the use of separate electronically-synchronised drives in a cigarette making machine. Reference is directed to that specification in its entirety.

According to one aspect of this invention, a rod cut-off for a cigarette making machine comprises a cutting device having a first drive, a ledger for supporting the rod during cutting and having a second drive separate from the first drive, means for sychronising (preferably electronically) the first and second drives during normal operation, and means for mechanically displacing the ledger or cutting device (preferably the former) from the normal position in which it co-operates with the other member to perform rod cutting, the displacement being arranged to occur while the two drives are being brought into sychronisation, this being normally while the machine is being accelerated from start.

This not only avoids the need for gearing or other mechanical drive means between the cutting device and the ledger, but also facilitates rod length changes necessitating tilting of the cutting device with respect to the rod. An example of a cutting device requiring such tilting is described in our patent GB1238458.

As described in U.S. Pat. No. 4,463,766, the drive to the cutting device is preferably a "master", the ledger drive being electronically "slaved" to the master.

The ledger is preferably of the type having only rotating components; ie, as opposed to ledgers comprising a reciprocating or oscillating arm. The simplest example of such a ledger (shown in GB1238458) is a wheel having a shaped periphery constantly engaging the rod during normal operation and formed with radial slits through which a cutting knife (or one of a number of knives on the cutting device) passes while cutting the rod. Other examples are described in U.S. Pat. Nos. 3,479,913, 3,650,169, 3,850,065 and 3,956,955.

This invention has wider implications, particularly in regard to devices in machines of the cigarette industry which can benefit from the use of separate drives but need to be synchronised to allow appropriate engagement or co-operation of respective parts thereof.

According to a second aspect of this invention, a machine of the cigarette industry including two devices which co-operate during use and have hitherto been driven by a common motor via appropriate gears or other mechanical drive means is characterised by having separate drives for the two devices, means for electronically synchronising the two drives during normal operation, and means for displacing one of the devices from the other until the drives have been brought into synchronisation.

An example of an apparatus to which this second aspect of the invention may be applied is the part of a filter tipping machine used for cutting a continuous web of tipping paper into predetermined lengths. An example of such apparatus is described in U.S. Pat. No. 4,372,327. In that example, the drum serving an an anvil for the cutting knives on the cutting head may have a drive separate from the cutting head. Displacement of the cutting head from the drum (as described in that specification) may be effected automatically when the machine is first started, restoration of the normal cutting position of the cutting head occurring once the drives have been synchronised and tipping paper is being fed through the apparatus.

This invention may also be applied to apparatus outside of the cigarette machine industry.

An example of a cigarette rod cut-off according to this invention is shown in the accompanying diagrammatic drawing.

In the drawing, a ledger 10 is shown diagrammatically to comprise a vertical-axis wheel 12 carrying a number of 30 circumferentially spaced rod-supporting parts 14 (or a continuous outer part of the same cross section) formed with grooves 16 of semicircular cross section for engaging a cigarette rod 18. The wheel is mounted on a shaft 20 extending from a drive 22 which in turn is mounted on a bracket 24 engageable with adjustable stops 25 and 27.

A fixed member 26 carries the bracket 24 via a pivot 28. During normal operation, the position of the wheel 12 is as shown in continuous outline. During such operation, one or more knives 30 of a rotating cutting device 32 are synchronised to pass through slots in the members 14 so to cut the rod at predetermined intervals. The cutting devices 32 is mounted on a shaft 34 driven by a "master" drive 36.

While the machine is being accelerated up to full speed, an electronic control system responsive to the speed and phase of the two drives (e.g. as described in U.S. Pat. No. 4,463,766) operates automatically to bring the drive 22 into synchronisation with the drive 36. Until synchronisation has been achieved, the ledger is displaced from the rod by the action of an actuator 40 mounted on the fixed member 26. The actuator may be pneumatic and includes an axially movable rod 42 which is pivoted to the bracket 24 by a pin 44. Movement of the rod 42 into the body 40 of the actuator rotates the bracket 24 in a clockwise direction about the pivot 28 to the position shown in dotted outline. While the ledger is displaced in that manner, the rod-supporting parts 14 are clear of the knife or knives so that temporary lack of synchronisation does not matter.

When the drives are fully synchronised and a properly formed rod is being produced, the rod (which may initially be deflected out of its normal path, by a rod-breaking device as described in GB1547763) is directed along the path shown in the drawing so as to be supported by the ledger, which is returned by the actuator 40 to the operative position shown in solid outline. Operation of actuator 40 taking the ledger to the rod-supporting position may, subject to synchronisation with the cutting device, be arranged to occur at the same time as, or shortly before, the rod-breaking device is operated to break the rod and cause it to move along the normal operating path as shown in the drawing.

The use of separate drives for the cutting device and ledger allows the cutting device to be readily tilted about an axis 46 when the length of rods cut by the cutting device is required to be changed.

Retraction of the ledger may also be arranged to occur automatically in the event of a machine malfunction of any type (or of one or more specific types) being detected.

In the control circuits for the two drives, the respective "servo gains" and preferably matched so that the error in one drive as it accelerates towards operating speed, and is being brought into synchronisation with an electronic master signal, is substantially equalled by the error in the other drive. In practice this may be achieved by de-tuning the servo gain of the drive 22 until it equals that of the drive 34, the latter being likely to be the more prone to error on account of the higher inertia of the cutting device 32.

I claim:

1. A rod-making machine of the cigarette industry including two cyclically movable devices which are arranged to co-operate during use, comprising separate drives for the two devices, means for electronically synchronising the two drives during normal operation, and means for displacing one of the devices from the other until the drives have been brought into synchronisation.

2. A roding-making machine according to claim 1 including means for detecting a malfunction and for actuating said displacing means in response to detection of the malfunction.

3. A rod cut-off for a cigarette making machine comprising a cutting device having a first drive, a ledger for supporting the rod during cutting and having a second drive separate from the first drive, means for synchronising the first and second drives during normal operation, and means for mechanically displacing the ledger or cutting device from a normal position in which it co-operates with the other member to perform rod cutting, the displacement being arranged to occur while the two drives are being brought into synchronisation.

4. A rod cut-off according to claim 3 in which the ledger is displaceable from its normal position, being mounted on a pivotably movable member whose position is controlled by an actuator.

5. A rod cut-off according to claim 4 in which the ledger comprises a rotary member carrying one or more rod-supporting parts formed with grooves arranged to engage partly around the rod while allowing the rod-supporting parts to be separated from the rod prior to synchronisation.

6. A rod cut-off according to claim 5 in which the ledger is displaceable by the actuator in a direction substantially at right angles to the axis of rotation of the rotary member.

7. A rod cut-off according to claims 4, 5 or 6 in combination with a rod-breaking device, the ledger being arranged to move to its normal operating position at the same time as, or shortly before, the rod-breaking device operates to enable properly formed rod to pass through the rod cut-off.

8. A rod cut-off according to claims 2, 3, 4 or 5, including means for detecting a malfunction and for actuating said displacing means in response to detection of the malfunction.

* * * * *